US007490573B1

(12) United States Patent
Dickinson

(10) Patent No.: US 7,490,573 B1
(45) Date of Patent: Feb. 17, 2009

(54) FAIRING FOR ARTICULATED TOW BODIES

(75) Inventor: Stuart C. Dickinson, Fairhaven, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 67 days.

(21) Appl. No.: 11/833,552

(22) Filed: Aug. 3, 2007

(51) Int. Cl.
*B63B 21/56* (2006.01)
*F15D 1/10* (2006.01)

(52) U.S. Cl. ..... 114/248; 114/243

(58) Field of Classification Search ..... 114/242–244, 114/248

See application file for complete search history.

(56) References Cited

U.S. PATENT DOCUMENTS 1,406,602 A * 2/1922 Baer ..... 114/249

6,182,593 B1 * 2/2001 Wierick ..... 114/249

FOREIGN PATENT DOCUMENTS

GB 2202946 A * 10/1988

* cited by examiner

*Primary Examiner*—Jesus D Sotelo
(74) *Attorney, Agent, or Firm*—James M. Kasischke; Michael P. Stanley; Jean-Paul A. Nasser

(57) ABSTRACT

A fairing assembly is provided for a towed body having multiple sections that are flexibly joined together. For each pair of sections, a fairing is joined to the first section and positioned over the space between the pairs of sections. The fairing has discrete tabs that extend from the first section across the space between the sections. The tabs are separated to allow angular displacement of the first section with respect to the second section. Two layers of overlapping tabs are provided for reducing hydrodynamic forces in between the sections.

14 Claims, 5 Drawing Sheets

FAIRING FOR ARTICULATED TOW BODIES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention is directed to drag reducing devices for use in fluid mediums and in particular to fairings used to reduce drag and splashing between adjacent floating elements passing through water.

(2) Description of the Prior Art

Objects moving through a fluid medium, for example air or water, experience drag forces associated with their movement. Objects that move through fluid mediums include objects that are towed through the water from a vessel on or below the surface of the water. Examples of objects towed through the water include dredges, sonar devices and fishing nets. Drag forces work against the movement of the object, extracting speed and energy. Therefore, the objects are engineered to minimize these forces. The engineering efforts involve modifications to the materials, shape and surface characteristics of the objects. In addition to the objects, lines, ropes or cables are used for towing the objects, and the length of these can be considerable, resulting in a large amount of additional drag. Methods used to reduce the drag associated with these tow members include attaching fairings along the length of the member.

In general, fairings are formed like aerofoils or aerofoil sections that extend around a tow member such as a cable. Since the cable is flexible and the fairing sections can move or pivot about the cable, misalignments between the fairing sections and the direction of movement, i.e., direction of flow of the fluid medium around the cable, result in forces that push the cable to the sides, i.e., perpendicular to the direction of movement. These side forces result in a loss of control of the towing vessel. Also, the towing cable can be pulled out of handling equipment such as a sheave wheel. This can result in significant damage or complete loss of equipment. In addition to problems with misalignment, the fairing sections can migrate or move along the length of the cable, damaging the fairing sections.

Attempts at providing improved fairings for tow cables are illustrated in U.S. Pat. Nos. 4,836,122, 4,700,651, 4,398,487 and 4,075,967. These fairings, however, are for cables that pull objects below the water and are specifically adapted to reduce the drag on long, generally cylindrical cables. The cables are either long, unitary cables or cables constructed in sections. These sections, however, move through the water laterally not longitudinally. Thus, the hydrodynamic forces are forces perpendicular to the axis of the towed sections.

Applications exist where objects are arranged as a series of sections that are towed along the surface of the water or through the water. Each section is capable of articulation with respect to the adjoining sections, and the articulated sections move through the water in series, one behind the other. Therefore, disturbances in the water caused by a leading section affect trailing sections. In addition, the gap between adjacent sections that are used to provide the desired degree of movement between adjacent sections results in additional undesirable forces.

An example of an object arranged as a series of articulated sections is the multi-element buoyant cable antenna (MBCA), which is an antenna arranged to float horizontally on the sea surface and operate while being towed. Usual towing speed of such an antenna is about six knots. In one arrangement, the MBCA includes multiple pressure vessels which house the antenna, electrical, and connection components. The pressure vessels keep the contained components dry. Between the pressure vessels are a series of floats that are used to reduce the specific gravity of the overall assembly, allowing the antenna to protrude out of the water as much as possible. The floats are segmented to allow the assembly to conform to the water surface, e.g., waves, and to allow movement and turning of the assembly.

The spaces between the sections create drag and also cause splashing as the sections are towed through the water. Previous attempts at reducing drag have used hydrodynamic fairings placed between adjacent sections. These fairings were arranged as rectangular fabric pieces that were wrapped approximately one and one half times around the girth of each section. The rectangular fabric pieces, however, buckled when the sections articulated and become entrapped in the spaces between the sections, reducing the effectiveness of the fairing.

Therefore, the need exists for a fairing to be used between articulated sections to reduce the drag and splashing. In addition, the fairing should facilitate a sufficient range of articulation between adjacent sections while still providing the benefits of drag and splash reduction.

SUMMARY OF THE INVENTION

The present invention is directed to fairings that are arranged to reduce drag and splashing as buoyant object are towed on or below the water surface in the presence of waves. In accordance with exemplary embodiment of the present invention, a hydrodynamic fairing is provided that extends into the space between two articulated solid bodies. The fairing remains streamlined as the angle between the two bodies varies from zero to about twenty degrees. If the fairing is moved from a preferred position with respect to the two adjacent objects, the motion of the water or fluid medium in which the objects are disposed realigns the fairing components. In one embodiment, the fairing is disposed between adjacent flotation sections of the multi-element buoyant cable antenna (MBCA).

The shape of the sheet of material that forms the fairing between adjacent sections moving in series is modified to provide for adequate movement between adjacent sections. In particular, tabs are formed in the sheet of material, for example by providing a series of triangular cutouts on the trailing edge of the sheet creating a plurality of discrete tabs in the fairing. The cutouts are disposed in the space between the trailing edge of the first or upstream section and the leading edge of the second or downstream section. The tabs are spaced and arranged such that when the sheet of material is wrapped around a given section, the cutouts in an inner layer are substantially, if not entirely, covered by the tabs in one or more subsequent outer layers. Therefore, the hydrodynamic fairing disposed between two articulating sections remains streamlined and properly positioned over the space between the adjacent sections as the angle between the two sections varies over a range from zero to about ten or up to twenty degrees.

DETAILED DESCRIPTION OF THE INVENTION

Exemplary embodiments of hydrodynamic fairing assemblies in accordance with the present invention reduce the adverse effects of drag as objects or sections move through a fluid medium or, conversely, as the fluid medium moves over the objects or sections. In one embodiment, the fluid medium is water and the objects are buoyant objects that are towed across the surface of the water. Natural bodies of water, for example lakes, bays, sounds and oceans typically contain waves, and the hydrodynamic fairing assemblies of the present invention also reduce the adverse effects such as splashing that are caused in part by the waves as the objects move across the surface of the water. Embodiments of the hydrodynamic fairing assemblies in accordance with the present invention also reduce drag when the objects are towed below the water surface.

Figure 1:
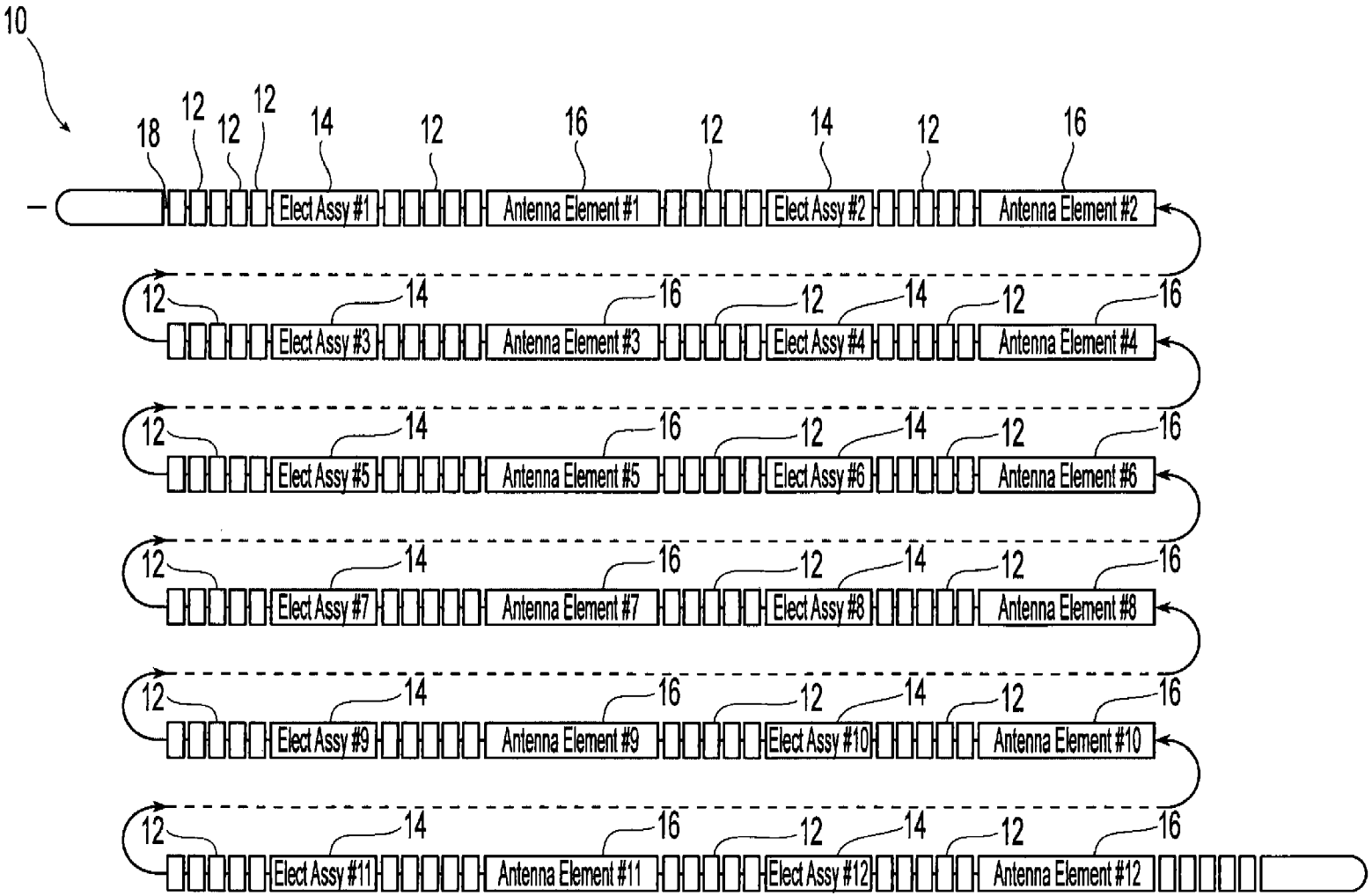
FIG. 1 is plan view of a multi-element buoyant cable antenna for use with embodiments of the fairing assembly in accordance with the present invention.

In one embodiment, hydrodynamic fairing assemblies are placed in the space between two articulated bodies or sections. In general, the two bodies or sections can move in one or more directions with respect to each other, for example, the sections move up and down with the movement of the waves as the sections are towed across the surface of the ocean. Referring initially to FIG. 1, in one embodiment, the fairing assembly is used in a multi-element buoyant cable antenna (MBCA) 10. This includes serially arranged flotation sections 12. Interspersed within the flotation sections are one or more electrical assemblies 14 and one or more antenna elements 16. A central flexible tow cable 18 extends through the entire antenna assembly 10 through all of the flotation sections 12, electrical assemblies 14 and antenna elements 16.

In use, the antenna 10 is towed along the surface of the water using the flexible tow cable 18 so that the flotation sections 12 move through or across the water in series. The flotation sections 12 are spaced apart from one another and the flexibility of the tow cable 18 allows adjacent pairs of flotation sections 12 to move with respect to each other. This movement can be the result of turns or adjustments in the direction in which the antenna 10 is being towed and to the rise and fall of the surface of the water. The angle between adjacent flotation sections 12 can vary up to twenty degrees as a result of this relative motion. In one embodiment, this angle is measured from an aligned position parallel to the tow cable 18, i.e., x-axis defined zero degrees, to the displaced float section 12 central axis. Angles can be measured in the orthogonal planes defined by the x-y axis pair, horizontal, or x-z axis pair, vertical. Float sections 12 can also be displaced laterally, while maintaining alignment with the x-axis, by about one quarter inch due to clearances between the float section inner diameter and the outer diameter of the central cable 18. In addition, the spaces between adjacent flotation sections 12 generate drag and splashing.

Hydrodynamic fairing assemblies in accordance with the present invention utilize sheets of materials that are attached to the flotation sections 12 and other sections and that span the spaces between adjacent sections. These sheets of material cover the spaces to reduce drag forces and splashing while allowing sufficient relative movement between adjacent sections. In addition, exemplary embodiments of hydrodynamic fairing assemblies in accordance with the present invention reduce buckling of the sheet of material when adjacent sections move with respect to one another. The relative motion of the fluid medium, e.g., the water, with respect to the flotation element sections realigns the sheet of material if the sheet of material is moved away from a preferred position.

Figure 2:
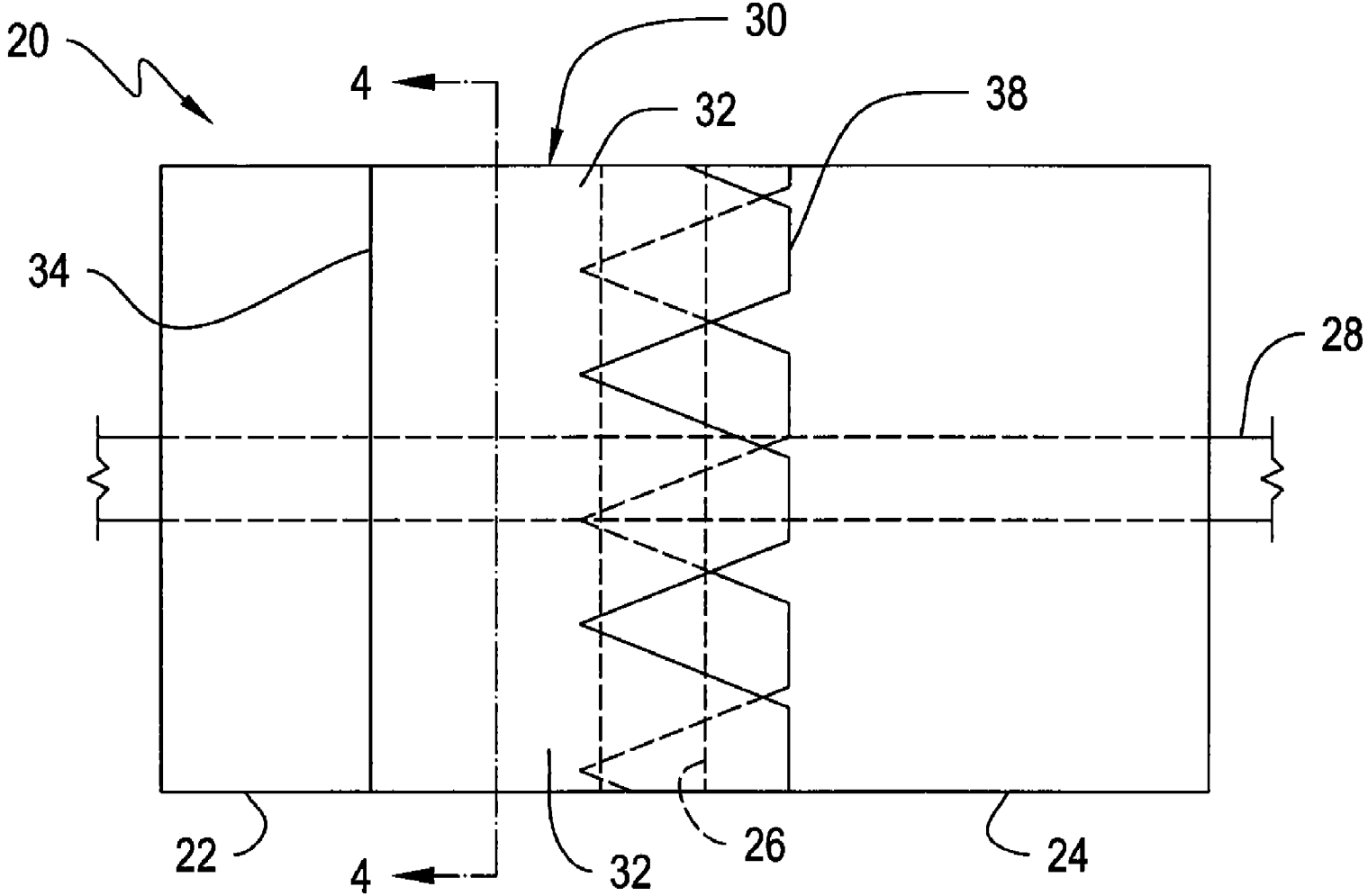
FIG. 2 is a plan view of an embodiment of a sheet of material for use in the fairing assembly of the present invention.

As illustrated in FIG. 2, a hydrodynamic fairing assembly 20 includes a first section 22 and a second section 24 moveably attached to the first section 22 and spaced therefrom, defining a space 26 disposed between the first and second sections 22 and 24. Sections 22 and 24 can be flotation sections 12, electrical assemblies 14 or antenna elements 16 as shown in FIG. 1. The sections can be constructed from any suitable material and can be tailored to the fluid medium in which the assembly is being used. In one embodiment, the first and second sections are constructed from buoyant materials such as polystyrene foam, syntactic foam or encapsulated lightweight material. The first and second sections can be cylindrical, conical or ellipsoidal in shape and have a generally circular cross-section. Other possible shapes include, but are not limited to, non-flow-separating, streamlined shapes for drag reduction or ship bow type shapes for reduced splash and wave formation. In order to permit relative movement between the sections, a flexible connection is provided between adjacent sections. Suitable flexible connections include swivel fittings. In one embodiment, the first and second sections are fixedly attached to a flexible cable 28. Flexible cable 28 can be made from metal, carbon fibers, aramid fibers, fiber glass or other like materials having sufficient tensile strength. In one embodiment, at least one of the first and second sections is not fixedly attached to the flexible cable, but is free to move laterally along the cable in accordance with free space tolerances manufactured into the various parts, i.e., cable lengths, diameters, float lengths and inner hole diameters.

Figure 3:
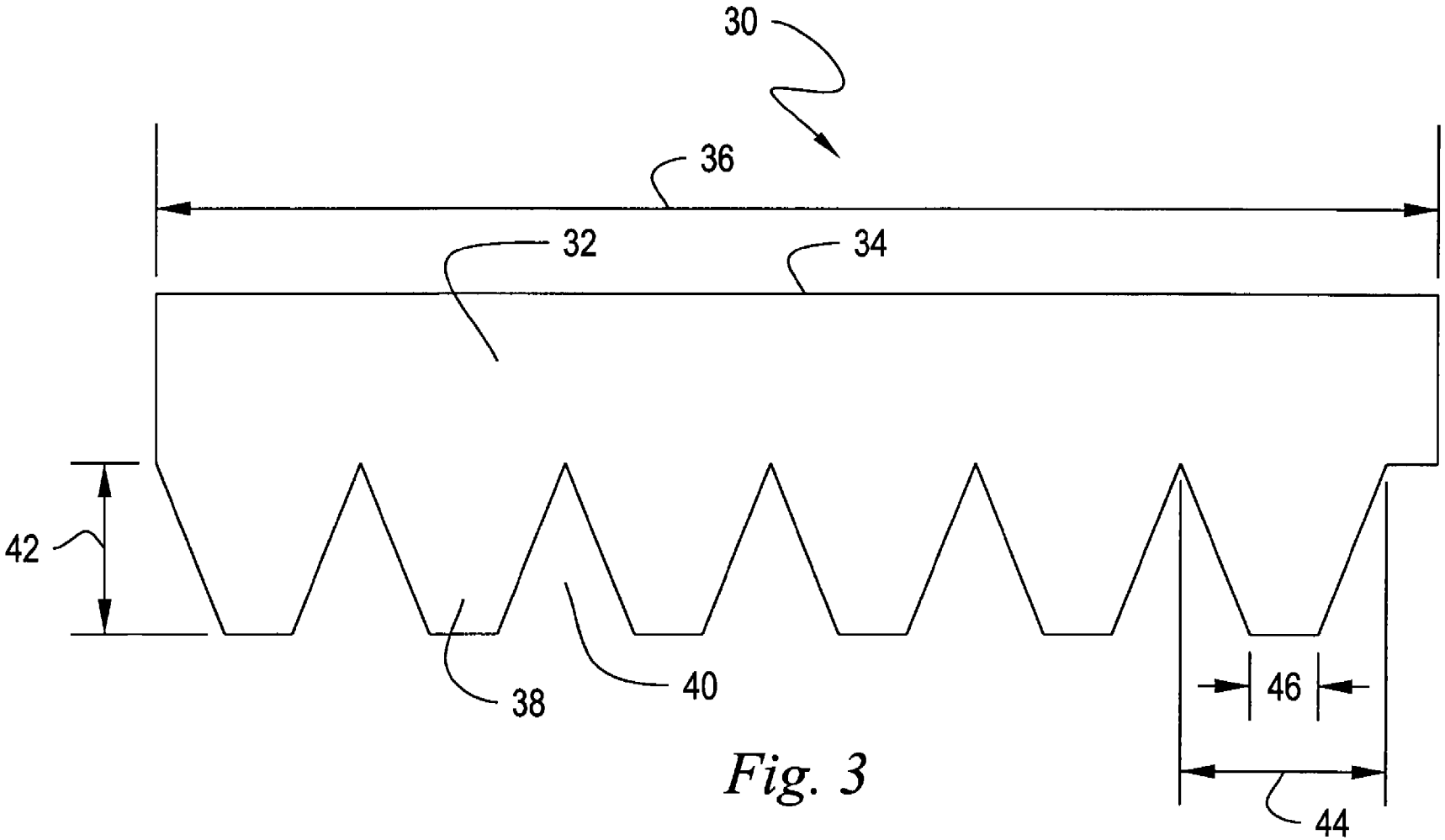
FIG. 3 is a plan view of an embodiment of a fairing assembly in accordance with the present invention.

Referring now to FIG. 3 in addition to FIG. 2, fairing 30 is provided as a thin sheet of material circumferentially attached to first section 22 and spanning the space 26 between first section 22 and its adjacent downstream section 24 and overlapping the downstream section 24. In embodiments containing a plurality of sections, a fairing 30 is provided for each pair of adjacent sections and is attached to the upstream section in a given adjacent pair. In the illustrated embodiment, fairing 30 includes a band portion 32 having a leading edge 34 with a length 36 equal to at least twice the circumference of the section 22 to which it is attached.

Each fairing 30 includes a plurality of discrete tabs 38 that can be disposed in the space 26 between adjacent sections. Tabs 38 extend rearward past space 26 a sufficient distance to at least partially overlap the second section 24. Therefore, tabs 38 extend in a generally downstream position. As illustrated in FIG. 2, the anticipated fluid flow direction is in the direction of arrow A. The tabs 38 can be sized and shaped in accordance with the number of times that the sheet of material wraps around the first section 22 such that the tabs 38 overlap sufficiently over the space 26 between adjacent sections to provide substantial coverage across the space between the first and second sections. This coverage reduces drag in the fluid medium caused by the space 26 between the first and second sections 22 and 24 as a result of fluid motion.

Suitable materials for fairing 30 include polyester fibers, for example Dacron® fibers commercially available from Invista Inc. of Charlotte, N.C., nylon fibers, aramid fibers, for example Kevlar® fibers commercially available from Dupont of Wilmington, Del. and combinations thereof. In general, the fibers used in the sheet of material can be varied depending on the application of the fairing assembly. In one embodiment, laminated materials such as those used for sailcloth can be utilized as the sheet of material. Some laminated materials have strongly anisotropic strength members. The strong axis could be aligned with the hydrodynamic forces to which the fairing assembly is to be subjected. Some laminated materials use sheet like material like polyester films, for example, Mylar®, commercially available from DuPont Teijin Films, and high tensile fibers such as aramid-based fibers, yielding a strong and relatively stiff sheet of material. The stiffness can be used to keep the tabs aligned in a pre-determined pattern. Other suitable sailcloth materials include the racing laminates available from Dimension Polyant, Krefeld, Germany, www.Dimension-Polyant.com.

Tabs 38 can be any suitable shape including, but not limited to rectangular tabs, square tabs, triangular tabs, semi-circular tabs, trapezoidal tabs and combinations thereof. As illustrated in FIGS. 2 and 3, tabs 38 are formed by a plurality of triangular cut-outs 40 in fairing 30. These cut-outs 40 become the spaces or gaps between tabs 38 that are covered by overlapping tabs 38 when the sheet of material is wrapped around a section. The triangular cut-outs 40 form a plurality of tabs 38 having a longitudinal length 42 suitable to span space 26 between adjacent sections. Upstream width 44 is greater than the downstream width 46. This arrangement, which is for a stiff laminated sailcloth material, allows the floats to articulate without the fairing 30 buckling while providing coverage with only two layers of material. Although illustrated with a trapezoidal shape having a reduced width downstream, tabs 38 can have any shape that lies along each section when being towed and provides the necessary coverage of space 26 is acceptable. In general, the plurality of discrete tabs 38 are sized and shaped such that each layer comprises a non-whole number multiple of tabs 38, where a layer is defined by a single complete wrap of the sheet of material around a section. In one embodiment, the tabs 38 are spaced in circumference so that the tabs repeat N+½ times, where N is an integer number, for one wrap around the circumference of the section. For example, if the section has a 2⅜" diameter and N=3, the spacing places a tab of the second layer centered on the cut out of the first layer creating a continuous fabric coverage in the space between adjacent sections.

Figure 4:
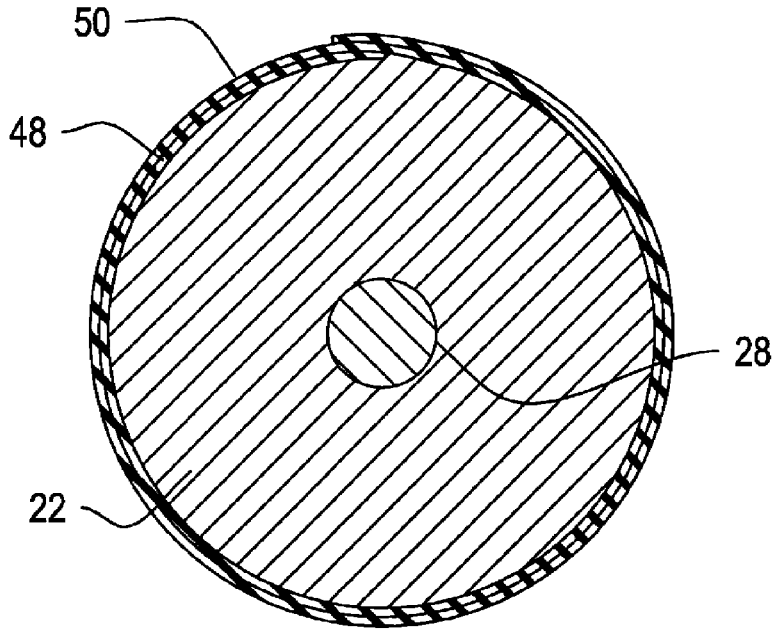
FIG. 4 is a view through line 4-4 of FIG. 3.

Therefore, as shown in FIG. 4, the fairing 30 can be embodied as sheet of material that wraps around the first section 22 twice, producing an inner layer 48 and an outer layer 50 of the sheet of material. Suitable methods for attaching the sheet of material to the sections are known and available in the art and include using adhesives, mechanical compression and fasteners. For example, waterproof glues can be used with sailcloth-type fairings or tensioned and crimped bands such as in a crate strapping system using appropriately sized stainless steel bands.

Figure 5:
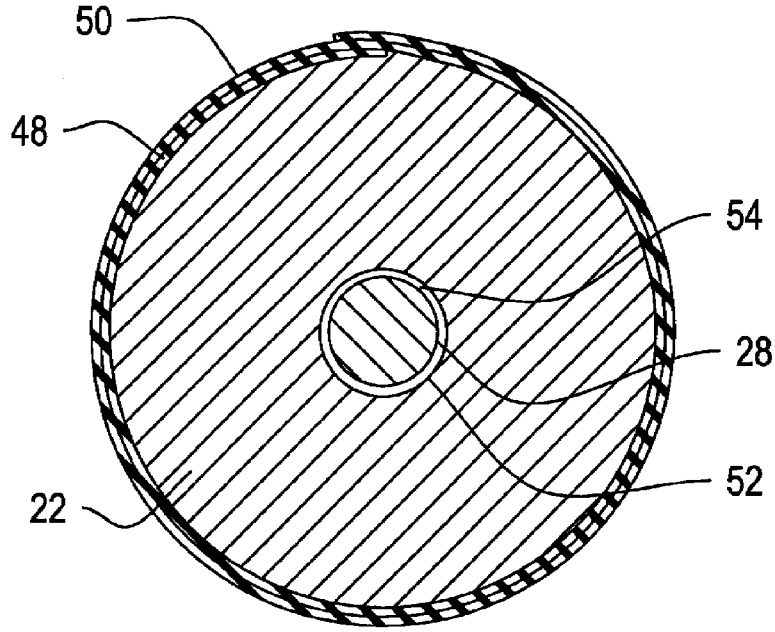
FIG. 5 is another embodiment of the cross-section view through line 4-4 of FIG. 3.

As illustrated in FIG. 5, an axial aperture 52 is provided in first section 22. Aperture 52 is sized to accept the cable 28 and to allow a small gap 54 between the cable 28 and the section 22, permitting movement of the section 22 along the cable 28.

Figure 6:
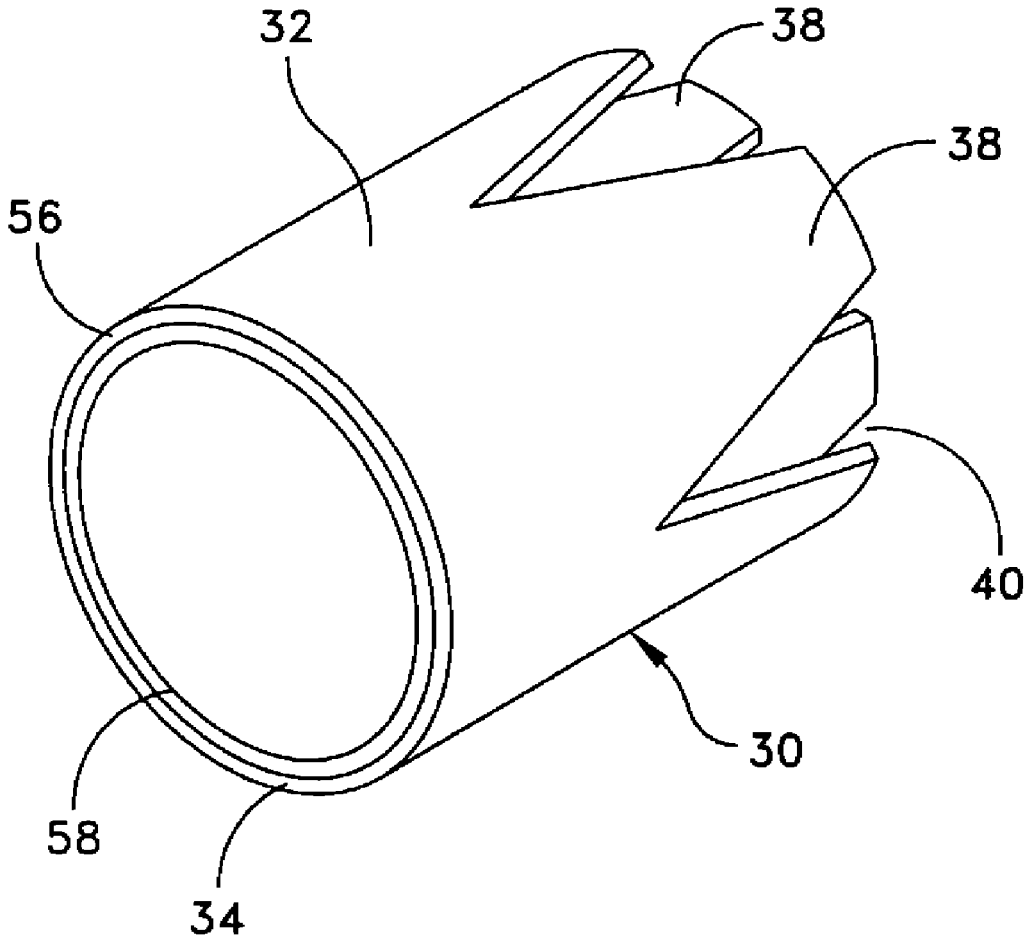
FIG. 6 is a perspective view of an alternate embodiment of the invention.

FIG. 6 provides an alternative to using a sheet of material wrapped around the section. Fairing 30 is made as a plurality of cylindrical members 56 and 58 having a leading edge 34 at the front of the fairing 30. Tabs 38 extend from edge opposite the leading edge 34. Multiple cylindrical members 56 and 58 can be positioned concentrically about a section with tabs 38 rotated to be offset from one another. Cylindrical members can be fastened by the same means used for the other embodiments.

Exemplary embodiments of the fairing assembly in accordance with the present invention provide for use between adjacent sections to reduce buckling when the sections articulate. Features are incorporated to use the relative motion between the sections and the fluid medium to realign the sheet of material if moved away from the preferred position. If a tab buckles enough to allow the section curvature and fabric stiffness to have the tab protrude normal to the section, hydrodynamic forces realign the tab.

Fairing 30 can be manufactured from a polyester fabric such as used as sailcloth for sailboats. The fabric is stiff and strong and suitable for the marine environment. It can be glued or sewn, and the edges can be heat sealed to reduce fraying. A range of weights and stiffnesses are available, and this stiffness is varied depending on specifics of a given application. Stiffer materials generally require more tabs to prevent large scale buckling. In general, the strength of the fabric is chosen to survive the drag forces of high speed towing and the life expectancy of the application.

Fairing assemblies in accordance with the present invention can span an articulating joint without large scale buckling, reducing drag. In addition, the fairing provides coverage of the space between adjacent sections moving through a fluid medium in series, preventing splashing caused by the gap. The fairing assembly is simple to manufacture using existing materials and techniques, light weight and compatible with the marine environment.

In alternative embodiments, the shape, arrangement and number of the tabs in the sheet of material are varied. In general, the wider the tab in relationship to the diameter of the section, the smaller the angle the section will be able to move with respect to adjacent sections. In one alternative embodiment, the number of tabs is increased until the sheet of material takes on the appearance of a "grass" skirt.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment (s). Therefore, it will be understood that the appended claims are intended to cover all such modifications and embodiments, which would come within the spirit and scope of the present invention.

What is claimed is:

1. A fairing assembly comprising:

a first section;

a second section flexibly attached to the first section and defining a space between the first and second sections; and a fairing fixedly attached around the first section circumference, said fairing having a plurality of discrete tabs extending from said first section at least partially across said space between said first section and said second section, said fairing having at least two layers of tabs, said tabs being shaped such that the tabs in each layer overlap the space sufficiently in combination to substantially cover the space.

2. The assembly of claim 1, further comprising a flexible cable joined as flexible attachment between the first and second sections.

3. The assembly of claim 1, wherein the fairing is made from a material selected from the group comprising plastics, polyester fibers, nylon fibers, aramid fibers and combinations thereof.

4. The assembly of claim 1, wherein the plurality of discrete tabs are made in a shape selected from rectangular tabs, square tabs, triangular tabs, semi-circular tabs, trapezoidal tabs and combinations thereof.

5. The assembly of claim 1, wherein said fairing is made from a sheet of material having a width of at least twice the circumference of said first section, said sheet being wrapped around said first section and secured.

6. The assembly of claim 5, wherein said layers are made from multiple wrappings of said sheet and said tabs are sized such that each layer comprises a non-whole number multiple of tabs.

7. The assembly of claim 1, wherein said fairing is made from at least two cylindrical portions attached concentrically about said first section, said cylindrical portions being arranged such that said tabs of that cylindrical portion are offset with respect to each other to substantially cover said space between said first section and said second section.

8. A towable object comprising:

a plurality of discrete sections flexibly joined in series, a space being defined between each adjacent pair of sections, each pair of sections being defined as a lead section and a trailing section;

a plurality of fairings, one fairing being provided for each pair of sections, each fairing fixedly attached around a circumference of the lead section, said fairing having a plurality of discrete tabs extending from said lead section at least partially across the space between the lead section and the trailing section, said fairing having at least two layers of tabs, said tabs being shaped such that the tabs in each layer overlap the space sufficiently in combination to substantially cover the space.

9. The assembly of claim 8, wherein selected ones of the plurality of sections are made from a buoyant material.

10. The assembly of claim 8, wherein the plurality of sections have a generally circular cross-section.

11. The assembly of claim 8, further comprising a flexible cable, the plurality of sections fixedly attached along a length of the flexible cable is series.

12. The assembly of claim 8, wherein said fairing is made from a sheet of material having a width of at least twice the circumference of said first section, said sheet being wrapped around said first section and secured.

13. The assembly of claim 12, wherein said layers are made from multiple wrappings of said sheet and said tabs are sized such that each layer comprises a non-whole number multiple of tabs.

14. The assembly of claim 8, wherein said fairing is made from at least two cylindrical portions attached concentrically about said first section, said cylindrical portions being arranged such that said tabs of that cylindrical portion are offset with respect to each other to substantially cover said space between said first section and said second section.

* * * * *